US008029329B2

(12) United States Patent
Greenley

(10) Patent No.: US 8,029,329 B2
(45) Date of Patent: Oct. 4, 2011

(54) DRUMMING ROBOTIC TOY

(75) Inventor: Peter Greenley, Lake Geneva, WI (US)

(73) Assignee: Rehco, LLC, Chicago, IL (US)

( * ) Notice: Subject to any disclaimer, the term of this patent is extended or adjusted under 35 U.S.C. 154(b) by 299 days.

(21) Appl. No.: 12/541,613

(22) Filed: Aug. 14, 2009

(65) Prior Publication Data

US 2010/0041307 A1 Feb. 18, 2010

Related U.S. Application Data

(60) Provisional application No. 61/089,182, filed on Aug. 15, 2008.

(51) Int. Cl.
*A63H 13/04* (2006.01)
*A63H 33/30* (2006.01)
*A63H 5/00* (2006.01)

(52) U.S. Cl. ..... 446/318; 446/408; 446/418

(58) Field of Classification Search ..... 446/298, 446/303, 318, 397, 408, 418, 484; 84/104, 84/405; 463/37

See application file for complete search history.

(56) References Cited

U.S. PATENT DOCUMENTS

| | | | | | |
|---|---|---|---|---|---|
| 1,914,652 | A * | 6/1933 | Stoer | 84/420 |
| 2,620,703 | A * | 12/1952 | Lebensfeld et al. | 84/420 |
| 3,427,745 | A * | 2/1969 | Duffy , Jr. | 446/299 |
| 4,778,432 | A * | 10/1988 | Yeu | 446/300 |
| 5,270,480 | A * | 12/1993 | Hikawa | 84/645 |
| 5,446,236 | A * | 8/1995 | Nakada et al. | 84/102 |
| 5,925,838 | A * | 7/1999 | Meng-Suen | 84/102 |
| D477,371 | S * | 7/2003 | Niu | D21/405 |
| 7,628,699 | B2 * | 12/2009 | Onoda et al. | 463/36 |

* cited by examiner

*Primary Examiner* — Gene Kim
*Assistant Examiner* — Alyssa Hylinski
(74) *Attorney, Agent, or Firm* — Adam K Sacharoff; Much Shelist

(57) ABSTRACT

A drumming toy is provided as having a center drumming apparatus and a pair of side drumming apparatus. The center drumming apparatus includes movable drumming pads with switches that activate when the pads are pressed downwardly. The activation controls sounds. The side drumming apparatuses include controlled drumming hands that act like or connect with a side drum. The controlled drumming hands movements are directed by an integrated circuit which controls the movement to mimic the pressing of the pads.

11 Claims, 5 Drawing Sheets

100

DRUMMING ROBOTIC TOY

CROSS REFERENCE TO RELATED APPLICATIONS

The present application claims priority to U.S. Provisional Application 61/089,182 filed Aug. 15, 2008.

FIELD OF THE INVENTION

The present invention relates to a toy and more particularly to a robotic drumming toy.

BACKGROUND OF THE INVENTION

Musical toys are well known. Toys that simulate musical instruments and playing instrumental sounds and notes are also known. However, there is a need to improve and provide different types of toys and a child finds is fun and enjoyable to play with.

Numerous other advantages and features of the invention will become readily apparent from the following detailed description of the invention and the embodiments thereof and from the accompanying drawings.

SUMMARY OF THE INVENTION

The present invention includes one or more embodiments relating to a drumming toy. In a first embodiment the drumming toy includes a center drumming apparatus having a main housing with a top portion and a plurality of movable drumming pads secured to the top portions of the main housing. Each drumming pad of the plurality of drumming pads has a corresponding switch positioned thereunder. When the movable drumming pads are pressed downwardly, the corresponding switch positioned thereunder is activated. At least one side drumming apparatus is connected about a side portion of the main housing. Each side drumming apparatus has a side drum housing, a drumming mechanism secured within the side drum housing, a drumming hand pivotally attached at a connection end to the drumming mechanism, and a side top drum. The drumming mechanism when activated pivotally moves a drum end defined by the drumming hand towards and away from the side top drum. An integrated circuit is in communication with the corresponding plurality of switches under the plurality of drumming pads which when activated direct preprogrammed responses from the integrated circuit. The integrated circuit is also in communication with each drum mechanism to control movement of the drumming arms in response to preprogrammed responses.

In a second embodiment the drumming toy includes a center drumming apparatus having a main housing with a top portion. A plurality of movable drumming pads secured to the top portions of the main housing. Each drumming pad of the plurality of drumming pads has a corresponding switch positioned thereunder. When the movable drumming pads are pressed downwardly, the corresponding switch positioned thereunder is activated. The toy also includes a pair of side drumming apparatuses. Each is connected about a side portion of the main housing and each has a side drum housing. A drumming mechanism is secured within the side drum housing. A drumming hand is pivotally attached at a connection end to the drumming mechanism, and a side top drum. The drumming mechanism when activated pivotally moves a drum end defined by the drumming hand towards and away from the side top drum. An integrated circuit is in communication with the corresponding plurality of switches under the plurality of drumming pads which when activate direct preprogrammed responses from the integrated circuit and the integrated circuit is also in communication with each drum mechanism to control movement of the drumming arms in response to preprogrammed responses.

In a third embodiment, a drumming toy is provided and includes a center drumming apparatus and a pair of side drumming apparatuses connected thereto. The center drumming apparatus includes movable drumming pads with switches positioned thereunder, which activate when the drumming pads are pressed downwardly. Each of the pair of side drumming apparatuses include drumming hands movably controlled by a drumming mechanism capable of moving the drumming hand towards side drum pads. An integrated circuit is in communication with the switches and has a memory portion to record an order in which the switches are activated. The integrated circuit is also in communication with the drumming mechanisms to move the drumming hands in response to the order in which the switches are activated to simulate a mimic playback of the pressing of the drumming pads.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
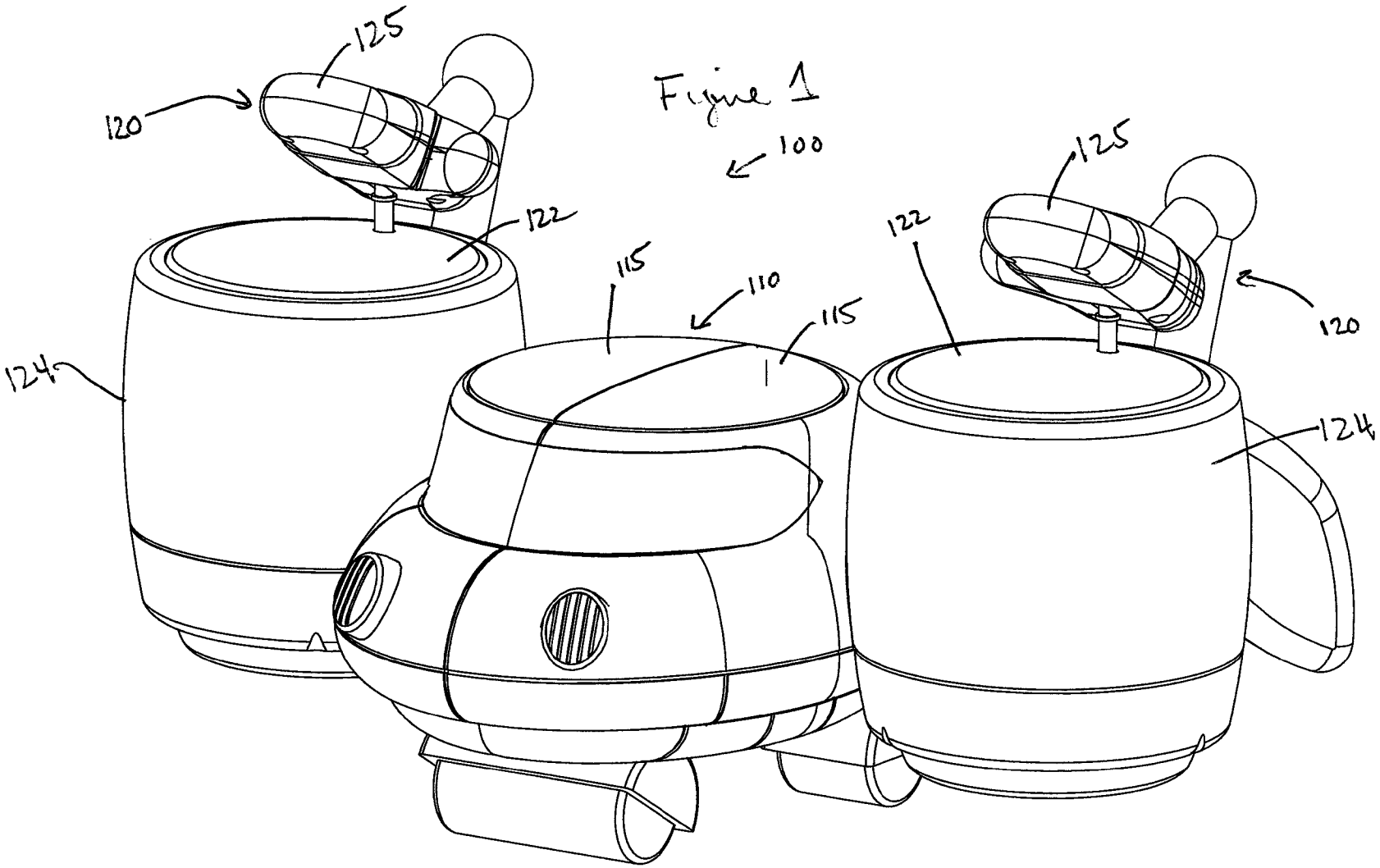
FIG. 1 is a front perspective view of a drumming robotic toy in accordance with an embodiment of the present invention and illustrating the hands in an up position.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention or the embodiments illustrated.

Referring now to FIG. 1, there is shown a robotic drumming toy 100. The toy drumming robot 100 includes a center drumming apparatus 110 and robotic drumming arms 120. The center drumming apparatus 110 permits a user to press, hit, and/or touch drumming pads 115 that when pushed down trigger a switch to release a drumming sound and/or begin recording a sequence. After the user is done using the center drumming apparatus 110, the robotic drumming arms 120 will simulate the users playing on side drums 124. The simulation can be completed with the robotic drumming arms 120 making contact on side drum pads 122 to simulate the sound, or could simply play-back the user's recorded sequence, or could play an entirely new sequence as a means to get the user to follow or copy the robotic drumming sequence. It is contemplated, that if the drumming robot 100 plays back the user's recorded sequence from a speaker rather than making actual contact with the side drum pad, that the side drum pad may not be a fully functional drums.

Figure 2:
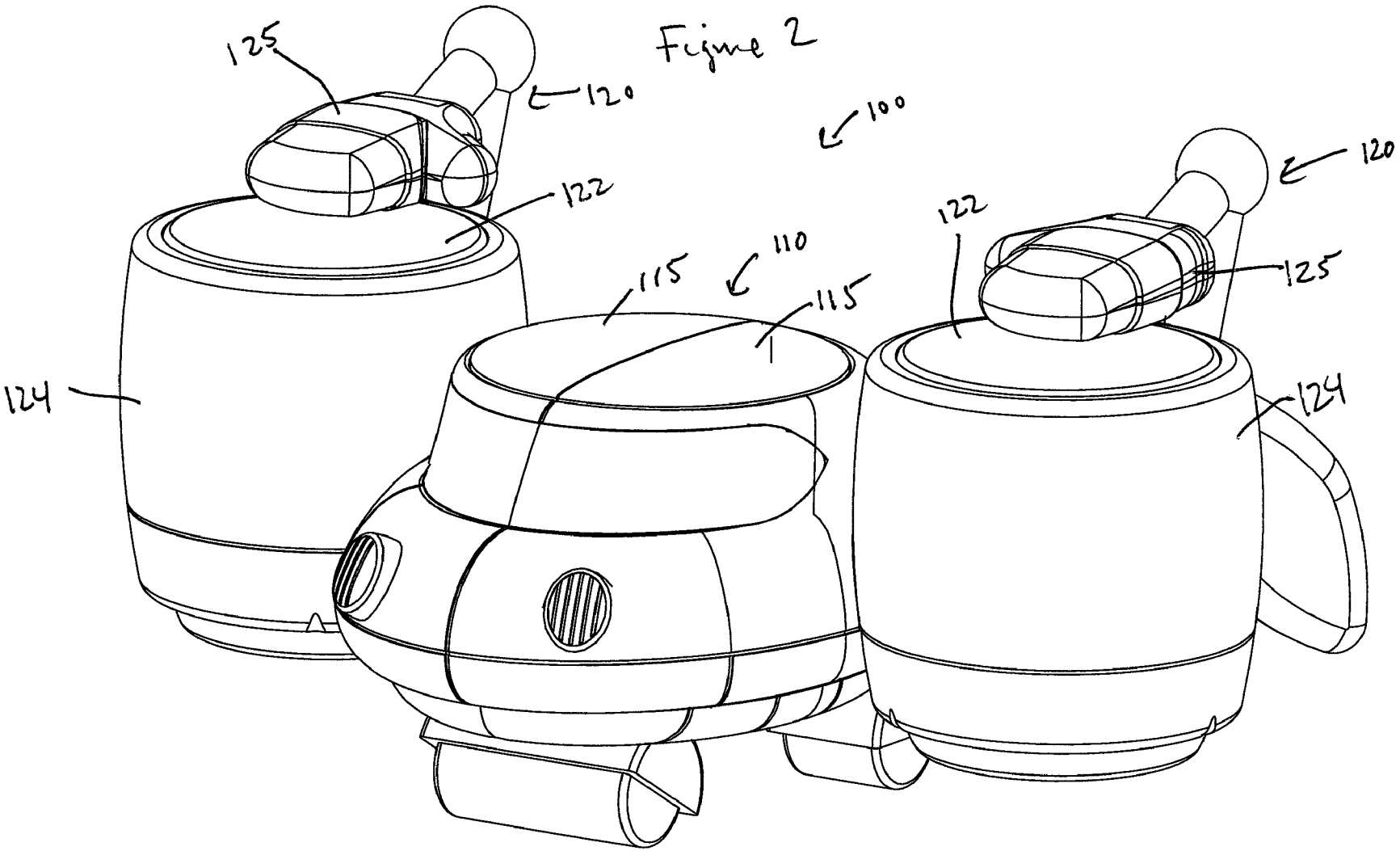
FIG. 2 is a front perspective view of a drumming robotic toy in accordance with an embodiment of the present invention and illustrating the hands in an down position.

In FIG. 1, the drumming robot 100 is shown as having a pair of drumming hands 125 connected to the ends of the drumming arms 120. The drumming arms 120 are opened palm similar to the playing of bongos or hand drums. It is also contemplated that the arms could be positioned in a closed hand fashion and positioned to hold a drum stick. Lastly, FIG. 1 shows the drumming hands 125 in an up position, while FIG. 2 shows the drumming hands near or in the down position.

Figure 3:
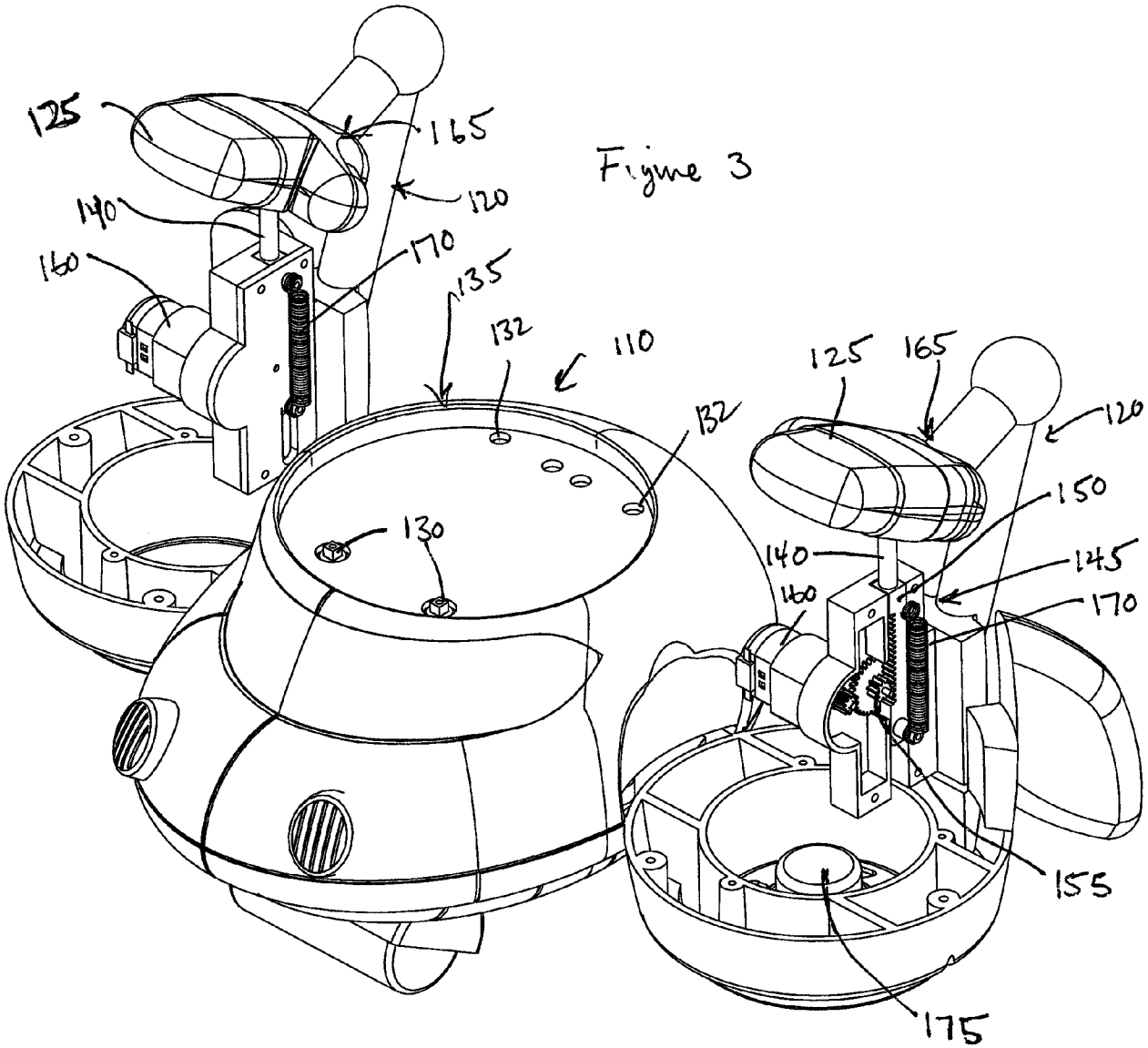
FIG. 3 is a front perspective view of a drumming robotic toy in accordance with an embodiment of the present invention and illustrating the hands in an up position and showing the internal components of the hands.

Referring now to FIG. 3, the drumming robot 100 is shown as having its drumming pads 115 removed. As depicted, the drumming robot 100 includes two drumming pads that are positioned above drumming switches 130 that when triggered activate programming in an integrated circuit. The activation could cause a sound to emanate simulating the playing of a drum or other instrument. The activation could cause lights 132 positioned under the drumming pads to eliminate. And the activation could cause the circuit to record the sequence played by the user for future playback. While two drum pads and two corresponding drum switches are illustrated, the drumming robot 100 could have a plurality of pads and corresponding switches. The drumming region 135 could be divided into multiple pads with corresponding switches and lights positioned for activation appropriately.

Still referring to FIG. 3, each drumming arm 120 includes a drumming hand 125 connected to a rod 140 that is movably connected to a drumming mechanism 145. The rod 140 is connected to a rack 150 and pinion gear 155 that is driven by a motor or servo 160. When the servo is activated, the rack 150 is moved in a first direction. The movement causes the drumming hand 125, which is pivotally connected at connection 165 to the drumming arm 120, to move in the same direction. The servo could be controlled to move in the opposite direction, or as depicted, the rack 150 can be connected to a spring 170 that biases the rack 150 in the opposite direction.

As mentioned above, if the side drum pads 122 do not make noise when contacted by the drumming hands, speakers 175 may be placed in each side drum 122 and used to emanate the sounds.

Figure 4:
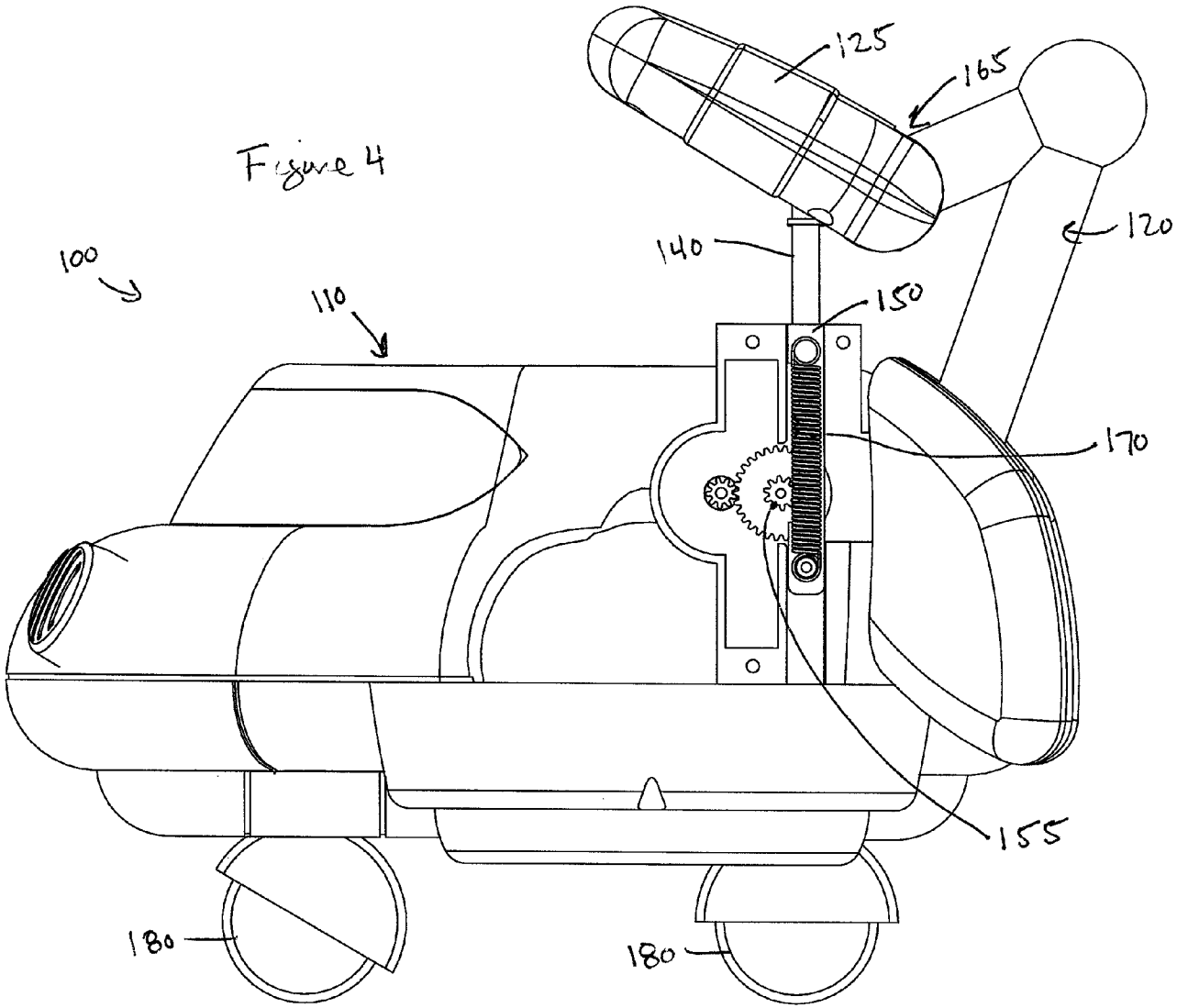
FIG. 4 is a side view of a drumming robotic toy in accordance with an embodiment of the present invention and illustrating the hands in an up position.

Referring now to FIG. 4, the drumming robot 100 may include other features such as wheels 180 that may be freely rotatable or controlled to drive the vehicle.

Figure 5:
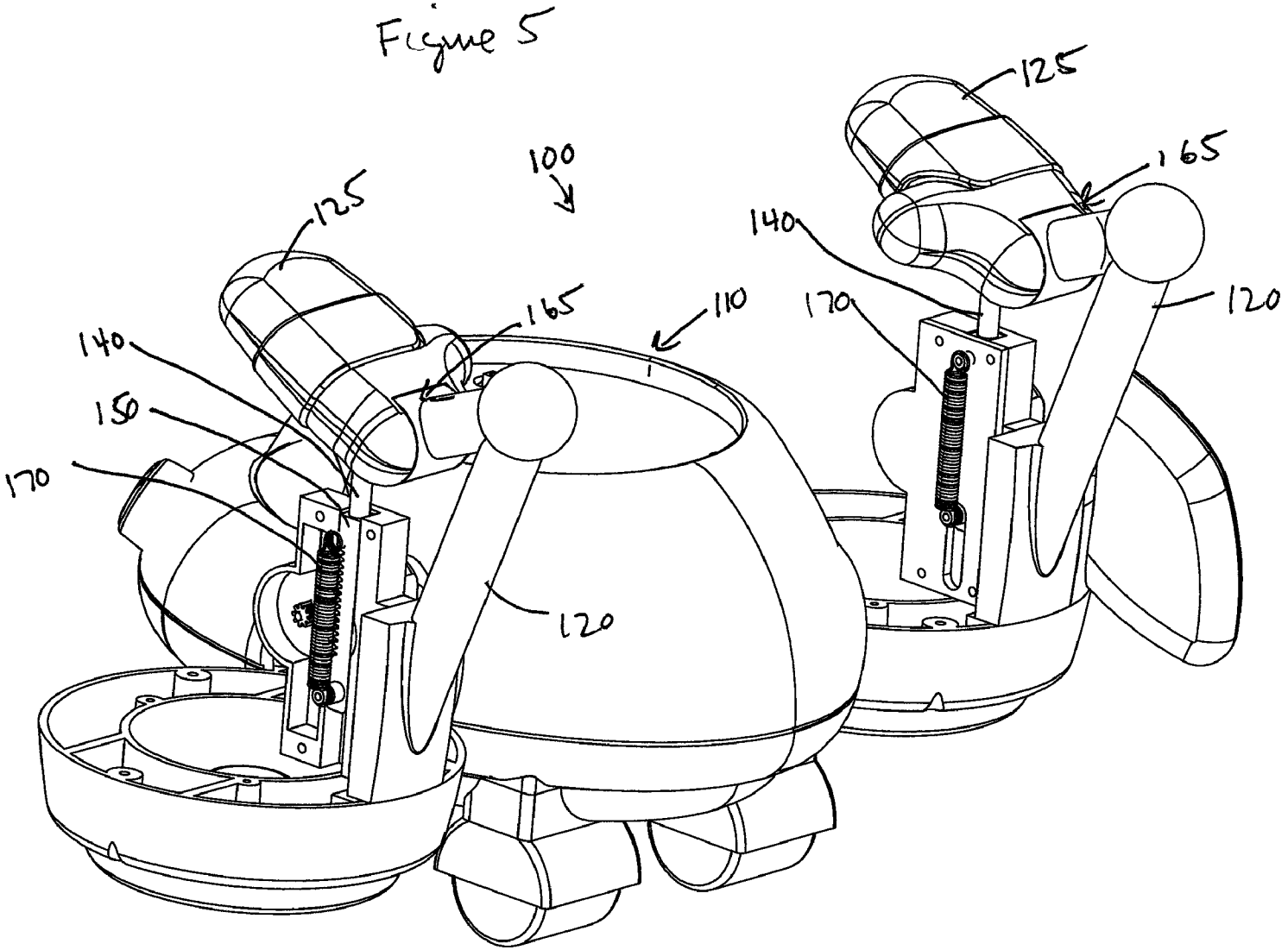
FIG. 5 is a rear perspective view of a drumming robotic toy in accordance with an embodiment of the present invention and illustrating the hands in an up position.

FIG. 5 illustrates the drumming robot 100 from its back side.

It is further noted that a lot of the electronics, circuit boards, and batteries/power supply can be placed in center drumming apparatus 110.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or inferred.

We claim:

1. A drumming toy comprising:

a center drumming apparatus having a main housing with a top portion;

a plurality of movable drumming pads secured to the top portion of the main housing, each drumming pad of the plurality of drumming pads having a corresponding switch positioned thereunder, wherein when the movable drumming pads are pressed downwardly, the corresponding switch positioned thereunder is activated;

at least one side drumming apparatus connected about a side portion of the main housing, the at least one side drumming apparatus having a side drum housing, a drumming mechanism secured within the side drum housing, a drumming hand pivotally attached at a connection end to the drumming mechanism, and a side top drum, the drumming mechanism when activated pivotally moves an end of the drumming hand towards and away from the side top drum, the end being opposed from the connection end; and an integrated circuit in communication with the corresponding plurality of switches under the plurality of drumming pads which when activated direct preprogrammed responses from the integrated circuit and the integrated circuit in communication with the drum mechanism controls movement of the drumming hand in response to the preprogrammed responses.

2. The drumming toy of claim 1, wherein the drumming mechanism includes a rod connected at a first end to a rack and pinion gear that is driven by a motor, the motor being controlled by the integrated circuit which when activated moves the rod upwardly and downwardly along the rack, the rod having a second end connected to the connection end of the drumming hand.

3. The drumming toy of claim 1, wherein the at least one side drumming apparatus is defined by having two side drumming apparatuses.

4. The drumming toy of claim 1 further comprising a speaker in communication with said integrated circuit such that the integrated circuit directs audio output to the speaker simulating the playing of a drum in accordance to preprogramming.

5. The drumming toy of claim 2, wherein the drumming mechanism further includes a compression spring secured to the rack and the side drum housing, the compression spring having a normal bias which keeps the drumming hand positioned away from the side top drum.

6. A drumming toy comprising:

a center drumming apparatus having a main housing with a top portion, a plurality of movable drumming pads secured to the top portion of the main housing, each drumming pad of the plurality of drumming pads having a corresponding switch positioned thereunder, wherein when the movable drumming pads are pressed downwardly, the corresponding switch positioned thereunder is activated;

a pair of side drumming apparatuses, each connected about a side portion of the main housing, each side drumming apparatus having a side drum housing, a drumming mechanism secured within the side drum housing, a drumming hand pivotally attached at a connection end to the drumming mechanism, and a side top drum, the drumming mechanism when activated pivotally moves an end of the drumming hand towards and away from the side top drum, the end being opposed from the connection end; and an integrated circuit in communication with the corresponding plurality of switches under the plurality of drumming pads which when activated direct preprogrammed responses from the integrated circuit and the integrated circuit in communication with each drum mechanism controls movement of the drumming hands in response to the preprogrammed responses.

7. The drumming toy of claim 6, wherein each drumming mechanism includes a rod connected at a first end to a rack and pinion gear that is driven by a motor, the motor being controlled by the integrated circuit which when activated moves the rod upwardly and downwardly along the rack, the rod having a second end connected to the connection end of the drumming hand and a compression spring secured to the rack and the side drum housing, the compression spring having a normal bias which keeps the drumming hand positioned away from the side top drum.

8. The drumming toy of claim 7 further comprising a speaker in communication with said integrated circuit such that the integrated circuit directs audio output to the speaker simulating the playing of a drum in accordance to preprogramming.

9. A drumming toy comprising:

a center drumming apparatus and a pair of side drumming apparatuses connected thereto;

the center drumming apparatus includes movable drumming pads with switches positioned thereunder and which activate when the drumming pads are pressed downwardly;

each of the pair of side drumming apparatuses includes a drumming hand movably controlled by a drumming mechanism to move the drumming hand towards a side drum pad; and an integrated circuit in communication with the switches and having a memory portion to record an order in which the switches are activated and the integrated circuit in communication with the drumming mechanisms moves the drumming hands in response to the order in which the switches are activated to simulate a mimic playback of the pressing of the drumming pads.

10. The drumming toy of claim 9, wherein each drumming mechanism includes a rod connected at a first end to a rack and pinion gear that is driven by a motor, the motor being controlled by the integrated circuit which when activated moves the rod upwardly and downwardly along the rack, the rod having a second end connected to a connection end of the drumming hand and a compression spring secured to the rack and the side drum housing, the compression spring having a normal bias which keeps the drumming hand positioned away from the side top drum.

11. The drumming toy of claim 10 further comprising a speaker in communication with said integrated circuit such that the integrated circuit directs audio output to the speaker simulating the playing of a drum in accordance to the activation of the switches and/or the movement of the drumming hands.

* * * * *